US008253676B2

(12) United States Patent
Watanabe et al.

(10) Patent No.: US 8,253,676 B2
(45) Date of Patent: Aug. 28, 2012

(54) METHOD FOR DRIVING AN ACTIVE MATRIX LIQUID CRYSTAL DISPLAY DEVICE

(75) Inventors: Hidetoshi Watanabe, Kobe (JP); Yasuyuki Onda, Kobe (JP)

(73) Assignee: Chimei Innolux Corporation, Miao-Li County (TW)

( * ) Notice: Subject to any disclaimer, the term of this patent is extended or adjusted under 35 U.S.C. 154(b) by 701 days.

(21) Appl. No.: 12/188,744

(22) Filed: Aug. 8, 2008

(65) Prior Publication Data

US 2009/0040162 A1 Feb. 12, 2009

(30) Foreign Application Priority Data

Aug. 9, 2007 (JP) ..... 2007-207697

(51) Int. Cl.
*G09G 3/36* (2006.01)

(52) U.S. Cl. ..... 345/96; 345/54; 345/209

(58) Field of Classification Search ..... 345/87–96, 345/204–206, 209–213, 50–54
See application file for complete search history.

(56) References Cited

U.S. PATENT DOCUMENTS

| | | | | |
|---|---|---|---|---|
| 6,104,367 | A * | 8/2000 | McKnight | 345/94 |
| 6,636,193 | B1 * | 10/2003 | Asao et al. | 345/96 |
| 7,079,103 | B2 * | 7/2006 | Morita | 345/98 |
| 7,091,946 | B2 * | 8/2006 | Tsutsui et al. | 345/100 |
| 7,639,245 | B2 * | 12/2009 | Shimizu et al. | 345/204 |
| 7,777,737 | B2 * | 8/2010 | Akutsu et al. | 345/209 |
| 2002/0063669 | A1 * | 5/2002 | Yanagi et al. | 345/87 |
| 2002/0126107 | A1 * | 9/2002 | Inoue et al. | 345/204 |
| 2002/0175887 | A1 * | 11/2002 | Yamazaki | 345/87 |
| 2002/0190944 | A1 * | 12/2002 | Morita | 345/100 |
| 2002/0196241 | A1 * | 12/2002 | Morita | 345/204 |

FOREIGN PATENT DOCUMENTS

JP 2001-356746 12/2001

* cited by examiner

*Primary Examiner* — Amare Mengistu
*Assistant Examiner* — Dmitriy Bolotin
(74) *Attorney, Agent, or Firm* — Morris Manning & Martin LLP; Tim Tingkang Xia, Esq.

(57) ABSTRACT

A method for driving an active matrix liquid crystal display device of the invention is provided to drive a common voltage applied on a common electrode facing a pixel electrode by inversion for displaying a part of the display area, wherein the common voltage is controlled by synchronizing the polarity inversion timing of the common electrode with the scan timing of the pixel electrode in an initial position of the displayed area.

6 Claims, 11 Drawing Sheets

METHOD FOR DRIVING AN ACTIVE MATRIX LIQUID CRYSTAL DISPLAY DEVICE

CROSS REFERENCE TO RELATED APPLICATIONS

This application claims priority of Japanese Patent Application Serial No. JP2007-207697, filed on Aug. 9, 2007, the entirety of which is incorporated by reference herein.

BACKGROUND OF THE INVENTION

1. Field of the Invention

The present invention relates to a driving method for an active liquid crystal display device.

2. Description of the Related Art

In an active matrix liquid crystal display device, when a voltage with a predetermined waveform is applied on a common electrode facing a pixel electrode, the pixel electrodes in a display area are scanned from top to bottom, and a writing voltage with a predetermined waveform is applied on the source electrode, whereby a pixel voltage is generated between the pixel electrode and the common electrode for display.

To economize power consumption, sometimes, only a part of the display area is used.

In such a condition, the pixel voltage is only generated in between the pixel electrode and the common electrode of the displayed area. For example, one of the top, middle and bottom areas is displayed, or the top and bottom areas are displayed. The rest of the areas are OFF.

The method for driving an active matrix liquid crystal display device for displaying a part of the display area has been disclosed in many patents, such as JP 2001-356746.

Meanwhile, for an image formed by frame inversion driving or line inversion driving in a conventional active matrix liquid crystal display device, the display depth fades from top to bottom of the display area, which causes a non-uniform depth problem.

FIG. 6 depicts a display condition of a black image in the whole display area and voltage waveform of each electrode in an active matrix liquid crystal display device driven by a conventional method, in which a normally white display device is driven by frame inversion with inverting the common voltage waveform to display normally entirely areas.

As shown in FIG. 6, in each frame period, a voltage with an alternative waveform (low level when positive and high level when negative) is applied on a common electrode facing a pixel electrode.

For a black display area, a positive writing voltage, which is at a high level during the positive frame period of the common electrode, is provided and a negative writing voltage, which is at a low level during the negative frame period of the common electrode is provided to source electrodes for supplying writing signals to pixel electrodes. For a white display area, a positive writing voltage, which is at a low level during the positive frame period of the common electrode, is provided and a negative writing voltage, which is at a high level during the negative frame period of the common electrode, is provided.

The pixel electrodes are arranged as a matrix in the display area and scanned from the top to bottom of the display area.

For each pixel electrode, since the pixel electrodes are scanned in a period and the writing voltage (pixel voltage) is applied on the pixel electrodes, the writing voltage is held during a frame period.

The timing for applying and holding the pixel voltage on the pixel electrodes on the top, middle and bottom display area is different, wherein the timing begins earlier for pixel electrodes near the top display area and later for pixel electrodes near the bottom display area.

The pixel voltage applying on the pixel electrode for circuit characteristics is influenced by the polarity of the common electrode and the writing voltage provided to the source electrode to slightly increase or decrease.

For example, when the polarity of the common electrode changes from negative to positive, the holding voltage slightly increases after the inversion point. On the contrary, when the polarity of the common electrode changes from positive to negative, the holding voltage slightly decreases after the inversion point. The increase or decrease of the pixel voltage caused by polarity inversion of the common electrode is shown in FIG. 6.

When the positive writing voltage is provided from the source electrode to the pixel electrode, the pixel voltage in one of the top display area, the middle display area and the bottom display area is also reduced during the voltage holding period by the change of the common voltage from positive to negative.

However, the timing of applying and holding the pixel voltage in each pixel electrode has deviation corresponding to the scan timing of the pixel electrode.

The pixel voltage reduction caused by the inversion occurs near the end of the voltage holding period for the pixel electrode in the top display area, near the middle part of the voltage holding period for the pixel electrode in the middle display area, and near the beginning of the voltage holding period for the pixel electrode in the bottom display area.

To verify the display depth of each display area, the display depth is proportional to the integral value of the pixel voltage on the pixel electrode within the holding period. Thus, the display depth is proportional to the area of the hatched portion of the pixel voltage waveform in the top display area, middle display area and bottom display area of FIG. 6.

Since the timing of the pixel voltage reduction caused by the inversion of the common voltage is different for the top area, middle area and bottom area, the hatched portion of the waveform in the top display area is the largest, and the hatched portion of the waveform in the bottom display area is the smallest.

Therefore, the top display area has the greatest display depth, the bottom display area has the least display depth, and the middle display area has the intermediate display depth.

Since the display depth difference occurs when the pixel electrodes are scanned, as shown in FIG. 6, the display depths of the display areas fade from top to bottom, which is at the depth gradient problem in a conventional active matrix liquid crystal display device.

In addition to entirely displayed areas, the depth gradient problem in a conventional active matrix liquid crystal display device is also seen in the partially displayed areas.

FIG. 7 depicts a display condition of a black image in the partial display mode and voltage waveforms of each electrode in an active matrix liquid crystal display device driven by a conventional method, in which a normally white display device is driven by frame inversion with inverting the common voltage waveform to partially display.

The waveform of the common voltage is the same as the common voltage shown in FIG. 6. Voltage with an alternative waveform (low level when positive and high level when negative) is applied on a common electrode during the frame period.

A positive writing voltage, which is at a high level during the positive frame period of the common electrode, and a negative writing voltage, which is at low during the negative frame period of the common electrode, are provided for the source electrode during the scan timing of the partially displayed area. In FIG. 7, the solid line represents the source voltage for the display of the middle display area, and the broken line represents the source voltage for the display of the top or the bottom display area.

When the top display area is displayed, the broken line marked with "Top" represents the writing voltage for the source electrode. The writing voltage of each pixel electrode on the top display area in FIG. 7 is held during a frame period.

In the partially displayed mode, when no inversion of the common voltage occurs, the positive writing voltage for the source electrode changes from a high level to a low level during the voltage holding period of the pixel electrode.

The held pixel voltage of the pixel electrode of the top display area slightly decreases corresponding to the variation of the writing voltages, as shown in FIG. 7.

When the middle display area is displayed, the writing voltage of each pixel electrode on the top display area in FIG. 7 is held during a frame period.

When the common voltage is positive, the positive writing voltage for the source electrode changes from a high level to a low level during the voltage holding period of the pixel electrode.

The held pixel voltage of the pixel electrode in the middle display area is influenced by the change of the writing voltage and the inversion of the common voltage, as shown in FIG. 7, and has a two-step reduction.

When the bottom display area is displayed, the broken line marked with "Bottom" represents the writing voltage for the source electrode. The writing voltage of each pixel electrode on the bottom display area in FIG. 7 is held during a frame period.

The common voltage inverts from positive to negative during the pixel voltage holding period. When the common voltage is inverted, the writing voltage for the source electrode becomes high. This writing voltage is applied to a black display during the period of the positive common voltage and is applied to a white display when the common voltage changes to negative. Thus, the writing voltage changes when the polarity of the common voltage inverts.

The held pixel voltage in the bottom display area, as shown in FIG. 7, has a two-step reduction when the polarity of the common voltage is inverted.

The display depth is proportional to the integral value of the pixel voltage applied on the pixel electrode in the holding period. The hatched portion of the waveform in the top display area has the largest area, and the hatched portion of the waveform in the bottom area has the smallest area.

Even in a partially displayed condition, the top display area has the greatest display depth, the bottom display area has the least display depth, and the middle display area has the intermediate display depth. In the partially displayed condition, the depth gradient problem still exists.

Although one of the top, middle and bottom display areas is displayed in the partially displayed mode, the top and bottom display areas can also be displayed simultaneously, wherein the rest of the areas would be OFF, i.e. a partially split display mode.

Even for the partially split display mode, the depth gradient problem still exists.

FIG. 8 depicts a display condition of a black image in the partially split display mode and voltage waveform of each electrode in an active matrix liquid crystal display device driven by a conventional method, in which a normally white display device is driven by frame inversion inverting the common voltage waveform to partially display.

FIG. 8 shows a partially split display mode, wherein the top and bottom display areas are displayed, and the middle display area is OFF.

The common voltage has the same waveform as the common voltage in FIGS. 6 and 7. Voltage with an alternative waveform (low level when positive and high level when negative) is applied on a common electrode during the frame period.

A positive writing voltage, which is at a high level during the positive frame period of the common electrode, and a negative writing voltage, which is at a low level during the negative frame period of the common electrode, are provided for the source electrode during the scan timing of the partially split display area (top and bottom display areas).

The writing voltage (pixel voltage) of each pixel electrode on the top display area in FIG. 8 is held during a frame period, and the writing voltage (pixel voltage) of each pixel electrode on the bottom display area in FIG. 8 is held during a frame period.

Even in the partially split display condition, when no inversion of the common voltage occurs, the held pixel voltage rises or reduces due to the change of the writing voltage.

Meanwhile, for the top display area, the positive writing voltage provided for the source electrode changes from a high level to a low level and changes from a low level to a high level during the positive frame period of the common voltage and holding period of the pixel voltage of the pixel electrode in the top display area.

The held pixel voltage of the pixel electrode in the top display area, as shown in FIG. 8, slightly decreases corresponding to the initial variety of the positive writing voltage, and slightly increases corresponding to the variety of the positive writing voltage thereafter.

When the common voltage changes from positive to negative, the pixel voltage slightly reduces, and when a frame period of the pixel voltage of the pixel electrode in the top display area ends, it enters the frame period of a negative polarity of the common electrode.

Meanwhile, for the bottom display area in the partially split display mode, in the scan period of the pixel electrode, when the pixel voltage is held, the common voltage changes from positive to negative, and the writing voltage for the source electrode changes from a high level to a low level.

The held pixel voltage of the pixel electrode in the bottom area is influenced by the inversion of the common voltage and the writing voltage changes, as shown in FIG. 8, and has two-step reduction.

During the negative frame period of the common voltage, when the negative writing voltage changes from a low level to a high level, the pixel voltage slightly rises with respect to the change, and when a frame period of the pixel voltage of the pixel electrode in the bottom display area ends, it enters the frame period of a negative polarity of the common electrode.

Since the display depth of each display area is proportional to the integral value of the pixel voltage applied on the pixel electrode with respect to the holding period, the hatched area of the waveform of the pixel electrode in the top display area is larger than the hatched area of the waveform of the pixel electrode in the bottom display area.

Even in the partially split display condition, the depth gradient still exists.

In addition to the described conditions, when a DC voltage is provided to the common electrode to drive the display device, the depth gradient problem still exists.

FIG. 9 depicts a display condition of a black image in the partially display mode and voltage waveform of each electrode in an active matrix liquid crystal display device driven by a conventional method, in which a normally white display device is driven by frame/column inversion with the DC common voltage for partial display.

In FIG. 9, the common voltage, as DC voltage, is constant.

During the scan timing of the display areas in the partial display, for the black display areas, a positive writing voltage (high level with respect to the intermediate value of the source voltage amplitude) and a negative writing voltage (low level with respect to the intermediate value of the source voltage amplitude) are provided to the positive output source bus and the negative output source bus, respectively, as the black writing voltage.

FIG. 9 shows the black display in the display areas in a partial display mode. In the white display condition, during the scan timing of the display areas in the partial display mode, the high level voltage, which is almost the same as the predetermined voltage and the low level voltage, which is almost the same as the predetermined voltage, are provided to the positive output source bus and the negative output source bus respectively as the white writing voltage.

In FIG. 9, the solid line represents the source voltage in the middle display area for partial display. The broken line represents the source voltage in the top and bottom display areas for partial display.

When the top display area is displayed for partial display, the writing voltage marked by the broken line "Top" is provided to the source electrode. The writing voltage (pixel voltage) shown in FIG. 9 is held at the pixel electrode in the top display area during the frame period.

Even if the common voltage is a DC voltage, because the writing voltage from the source electrode varies, the pixel voltage held at the pixel electrode increases or decreases.

For example, when the top display area is displayed for partial display and the pixel voltage is held during the positive frame period, the writing voltage is applied to the source electrode changes from a black writing positive voltage of high level to a white writing positive voltage.

The pixel voltage held on the pixel electrode in the top display area slightly reduces as the writing voltage changes, as shown in FIG. 9.

When the middle display area is displayed for partial display, the writing voltage marked by the solid line is provided to the source electrode. The writing voltage (pixel voltage) shown in FIG. 9 is held at the pixel electrode in the middle display area during the frame period.

At this time, when the pixel voltage is held, the writing voltage for the source electrode changes from a high level of a black writing positive voltage to a white writing positive voltage, and changes from a positive writing voltage to a negative writing voltage.

The pixel voltage in the middle display area, influenced by the two-step writing voltage changes, as shown in FIG. 9, also has a two-step reduction.

When the bottom display area is displayed for partial display, the writing voltage marked by the broken line "Bottom" is provided to the source electrode. The writing voltage (pixel voltage) shown in FIG. 9 is held at the pixel electrode in the bottom display area during the frame period.

At this time, when the pixel voltage changes from the positive frame period to the negative frame period, the writing voltage from the source electrode becomes a high level as a writing voltage for a positive black display. When the pixel voltage enters the negative frame period, the writing voltage from the source electrode becomes a low level as a writing voltage for a negative black display. Thus, when the polarity of writing voltage changes, the level of the writing voltage changes.

The pixel voltage held on the pixel electrode, as shown in FIG. 9, has a two-step reduction when it changes from the positive frame period to the negative frame period and the writing voltage changes.

The amplitude of the source voltage is proportional to the integral value of the pixel voltage of the pixel electrode in the holding period. The hatched portion of the waveform in the top display area is the largest, and the hatched portion of the waveform in the bottom display area is the smallest.

Even when DC voltage is provided as the common voltage, the depth gradient problem still exists.

BRIEF SUMMARY OF INVENTION

A method for driving an active matrix liquid crystal display device of the invention is provided, in which, a common voltage applied on a common electrode facing a pixel electrode is driven by inversion for displaying a part of a display area, wherein the common voltage is controlled by synchronizing polarity inversion timing of the common voltage with scan timing of the pixel electrode in an initial position of the displayed area.

In addition, the polarity inversion timing of the common voltage is synchronized with the polarity inversion timing of the pixel voltage applied on the pixel electrode in an initial position of the displayed area.

In addition, the common voltage is controlled by synchronizing the polarity inversion timing of the common voltage with the scan timing of the pixel electrode in an initial position of one of the displayed areas.

In addition, the common voltage is controlled by synchronizing the polarity inversion timing of the common voltage with the scan timing of the pixel electrode in an initial position of the displayed area disposed at the end of scanning the pixel electrode in separated displayed areas.

In addition, an embodiment of a method for driving an active matrix liquid crystal display device is provided to apply a predetermined DC voltage as a common voltage on the common electrode facing a pixel electrode and a writing voltage as a pixel voltage on the pixel electrode to display a part of the display area, wherein the writing voltage is positive in a positive polarity period and negative in a negative polarity period with respect to an intermediate value of the amplitude of the writing voltage, and the common voltage is controlled by synchronizing polarity inversion timing of the writing voltage with scan timing of the pixel electrode in an initial position of the displayed area.

In addition, a part of a frame period corresponding to the period for scanning the pixel electrodes in non-displayed areas becomes a non-refresh frame period of the pixel electrodes when the pixel electrodes are not scanned.

In addition, the electronic device is a mobile phone, a digital camera, a personal digital assistant, a laptop, a desktop, a television, a vehicle display device, or a portable DVD device.

A detailed description is given in the following embodiments with reference to the accompanying drawings.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

Figure 1:
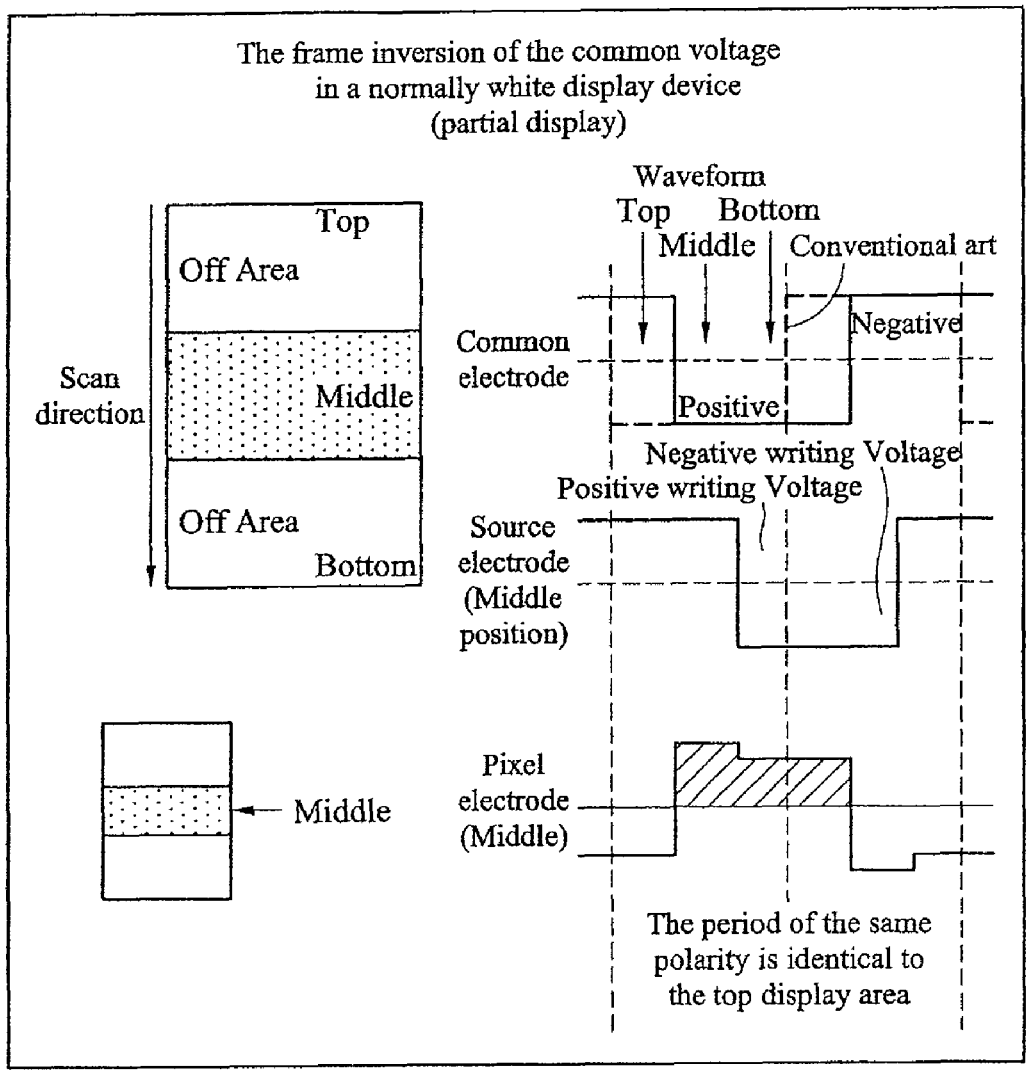
FIG. 1 depicts a display condition of a black image in a partial display mode and voltage waveform of each electrode in an active matrix liquid crystal display device using a method for driving the active matrix liquid crystal display device according to the first embodiment of the invention.

FIG. 1 depicts a display condition of a black image for partially display and voltage waveform of each electrode in an active matrix liquid crystal display device using a method for driving the active matrix liquid crystal display device according to the first embodiment of the invention. Specifically, FIG. 1 depicts a display condition of a middle display area for partially display and voltage waveform of each electrode in an active matrix liquid crystal display device driven by the frame inversion of the common voltage when the method of the invention is employed to normally white liquid crystal display.

The method for driving the active matrix liquid crystal display device of the invention is employed to control the voltage of the common electrode by synchronizing the polarity inversion timing of the common electrode with the scan timing of the pixel electrode on the top of the displayed area in a partially displayed mode.

The scan timing of the pixel electrode on the top of the displayed area in the partially displayed mode is also the polarity inversion timing of the pixel voltage applied on the pixel electrode on the top of the displayed area in the partially displayed mode. As a result, the polarity inversion timing of the common electrode is synchronized with the polarity inversion timing of the pixel voltage applied on the pixel electrode on the top of the displayed area in the partially displayed mode.

Thereby, even though a display area other than the top display area is displayed, by means of the method of the invention, the integral value of the pixel voltage applied and held on a pixel electrode in a frame period in other display areas will become the same as the integral value in the top display area, which results in the same display depth for the top display area and other display areas.

The embodiment of FIG. 1 describes a middle display area in a display area of a liquid crystal display device.

The waveform of the common voltage of the common electrode is synchronized with the scan timing of the pixel electrodes on the top of the middle display area. The polarity of the pixel voltage applied and held on the pixel electrodes on the top of the middle display area is inverted by synchronization with the polarity inversion timing.

Compared with the waveform of the common voltage of the common electrode controlled by the conventional method when synchronizing with the scan timing of the pixel electrodes on the top of the display area, the polarity inversion timing of the common voltage in the first embodiment of the method of the invention is delayed only in a period from the scan timing of the pixel electrodes on the top of the entire display area to the scan timing of the pixel electrodes on the top of the middle display area, as shown in FIG. 1.

Figure 6:
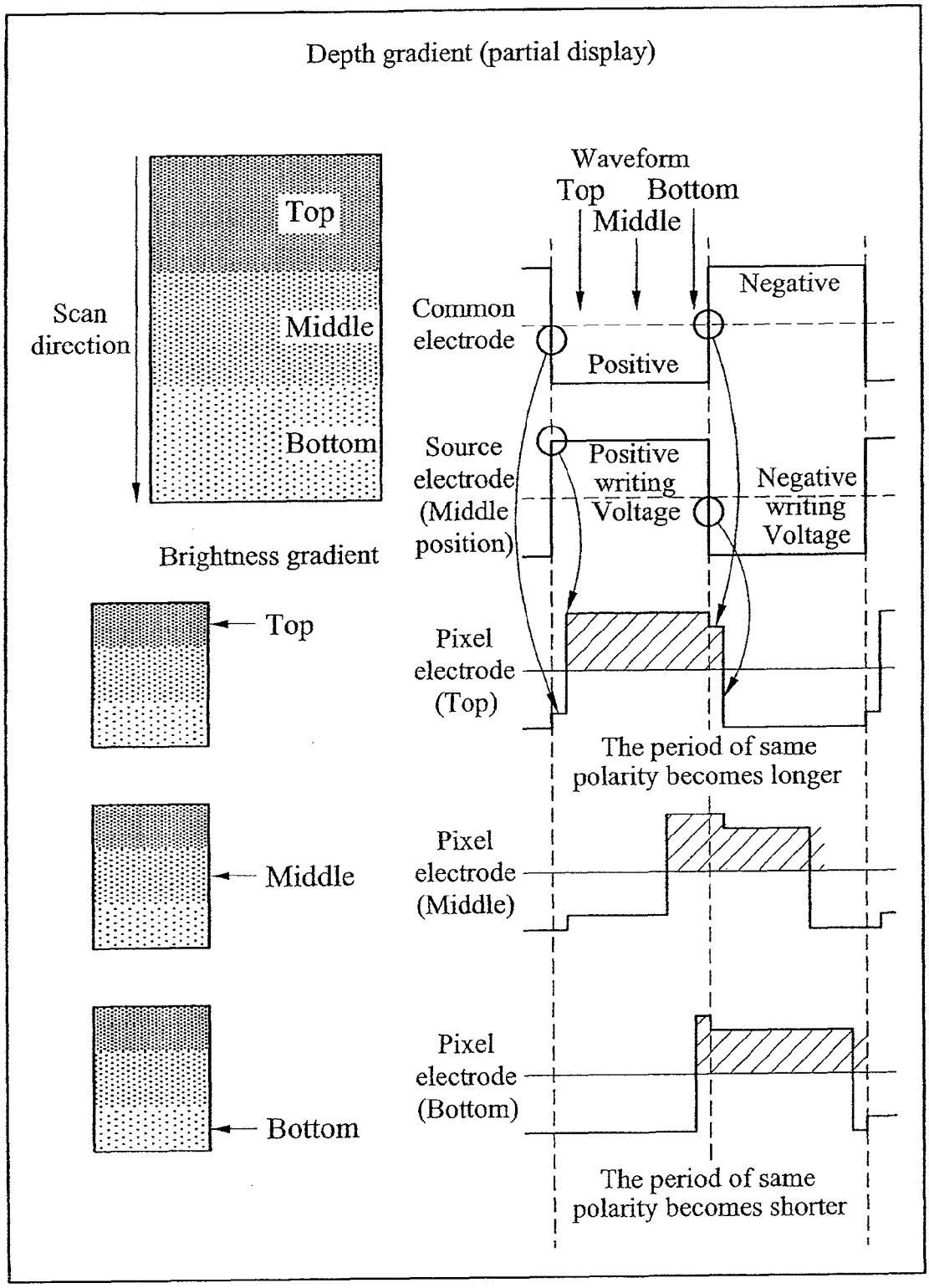
FIG. 6 (PRIOR ART)
FIG. 6 depicts a display condition of a black image in the whole display area and voltage waveform of each electrode in an active matrix liquid crystal display device driven by a conventional method, in which normally white display device is driven by frame inversion with inverting the common voltage waveform to display normally entirely areas.

The waveform of the common voltage of the common electrode is the same as the waveform of the common voltage as shown in FIG. 6, except for the deviation of the polarity inversion timing. An alternative voltage, with a low level at positive polarity and a high level at negative polarity, is applied on the common electrode.

On the other hand, a positive writing voltage for a black display, which is at a high level during the positive frame period of the common voltage, and a negative writing voltage for a black display which is at a low level during the negative frame period of the common voltage, are provided to the source electrode during the scan timing of the pixel electrodes on the middle display area in the partially displayed mode.

Figure 7:
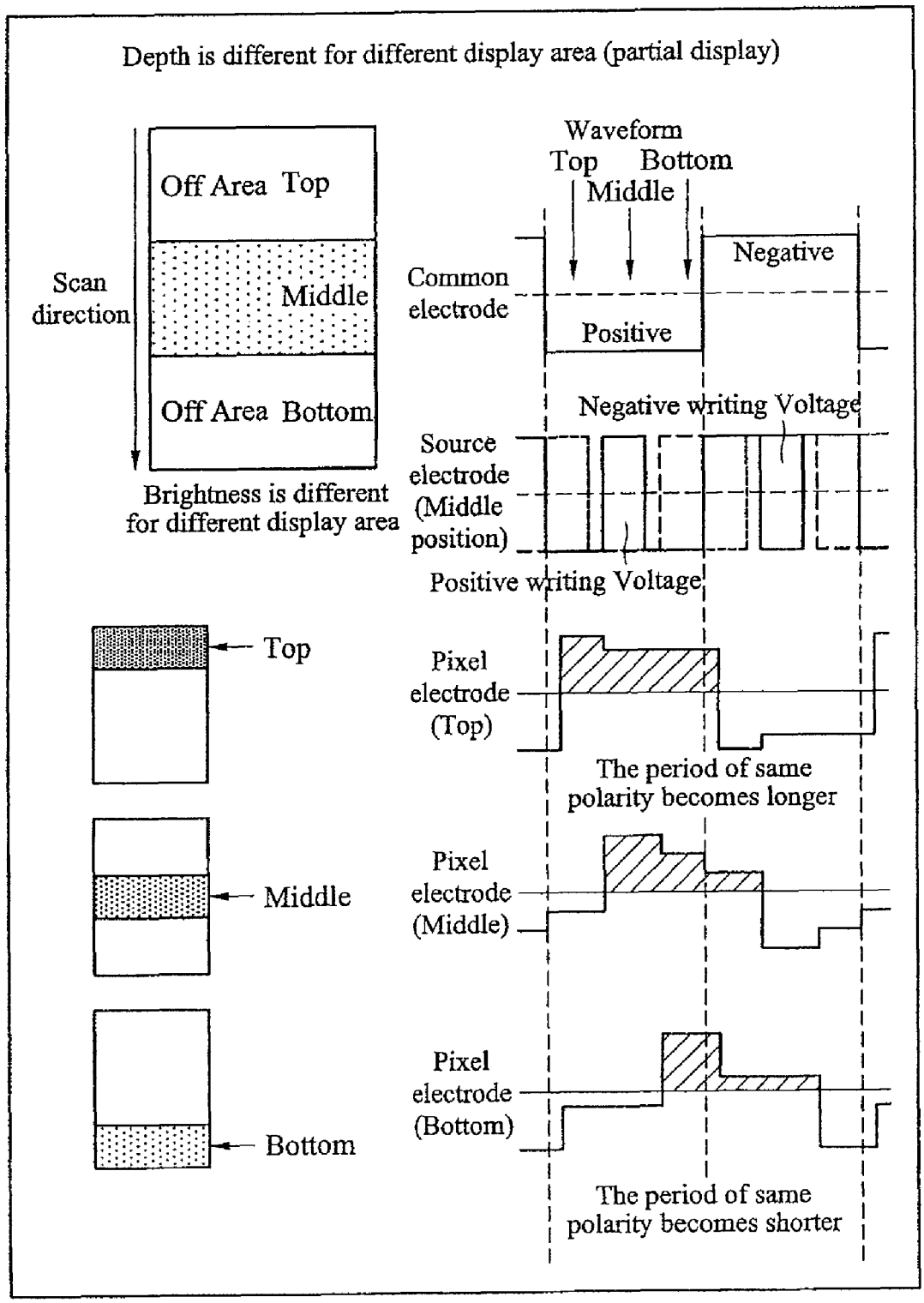
FIG. 7 (PRIOR ART)
FIG. 7 depicts a display condition of a black image in the partial display mode and voltage waveform of each electrode in an active matrix liquid crystal display device driven by a conventional method, in which a normally white display device is driven by frame inversion with inverting the common voltage waveform to partially display.

Although the first embodiment of the invention of FIG. 1 corresponds to the conventional method shown in FIG. 7, since the polarity inversion timing of the common voltage is different, the waveform of the writing voltage provided from the source driving circuit to the pixel electrode on the middle display area in the partially displayed mode is also different.

In FIG. 7, the polarity inversion timing of the common voltage is the same as the polarity inversion timing of the writing voltage. During the frame periods of scanning the pixel electrode on the middle display area, the writing voltage for a black display is at high level in the positive frame period and at a low level in the negative frame period.

In the first embodiment of the invention of FIG. 1, the common voltage is synchronized with the scan timing of the pixel electrodes on the top of the middle display area and the polarity of the common voltage is inverted. For example, the common voltage is in the negative frame period before the polarity inversion timing in the initial frame period, and in the positive frame period after the polarity inversion timing in the initial frame period. Before the polarity inversion timing in the initial frame period, a negative writing low-level voltage is provided as a negative white writing voltage. After the polarity inversion timing in the initial frame period, a positive writing high-level voltage is provided as a positive black writing voltage.

The common voltage is in the positive frame period before the polarity inversion timing in the next frame period, and in the negative frame period after the polarity inversion timing in the next frame period. Before the polarity inversion timing in the next frame period, a positive writing low-level voltage is provided as a positive white writing voltage. After the polarity inversion timing in the next frame period, a positive writing low-level voltage is provided as a negative black writing voltage.

Although the waveform of the writing voltage of the first embodiment of the invention in FIG. 1 is the same as the waveform of the writing voltage of the middle display area represented by the solid line in FIG. 7, since the polarity inversion timing is different, the waveform is different.

Since the polarity inversion timing is controlled, the pixel voltage, as shown in FIG. 1, has no reduction caused by the polarity inversion of the common voltage. Only when the level of the writing voltage changes, the pixel voltage will slightly reduce during the positive frame period and slightly rise during the negative frame period.

In FIG. 1, the integral value of the pixel voltage in the voltage holding period of the pixel electrode on the middle display area in the partially displayed mode, that is, the area of the hatched portion of the waveform of the pixel voltage is the same as the area of the hatched portion of the waveform of the pixel voltage of the pixel electrode on the top display area during the voltage holding period in FIG. 7.

The display depth of each display area is proportional to the integral value of the pixel voltage applied on the pixel electrodes of each display area during the voltage holding period.

Based on the method of the invention, the middle display area in the partially displayed mode has the same display depth as the top display area in the partially displayed mode of the conventional art.

Figure 2:
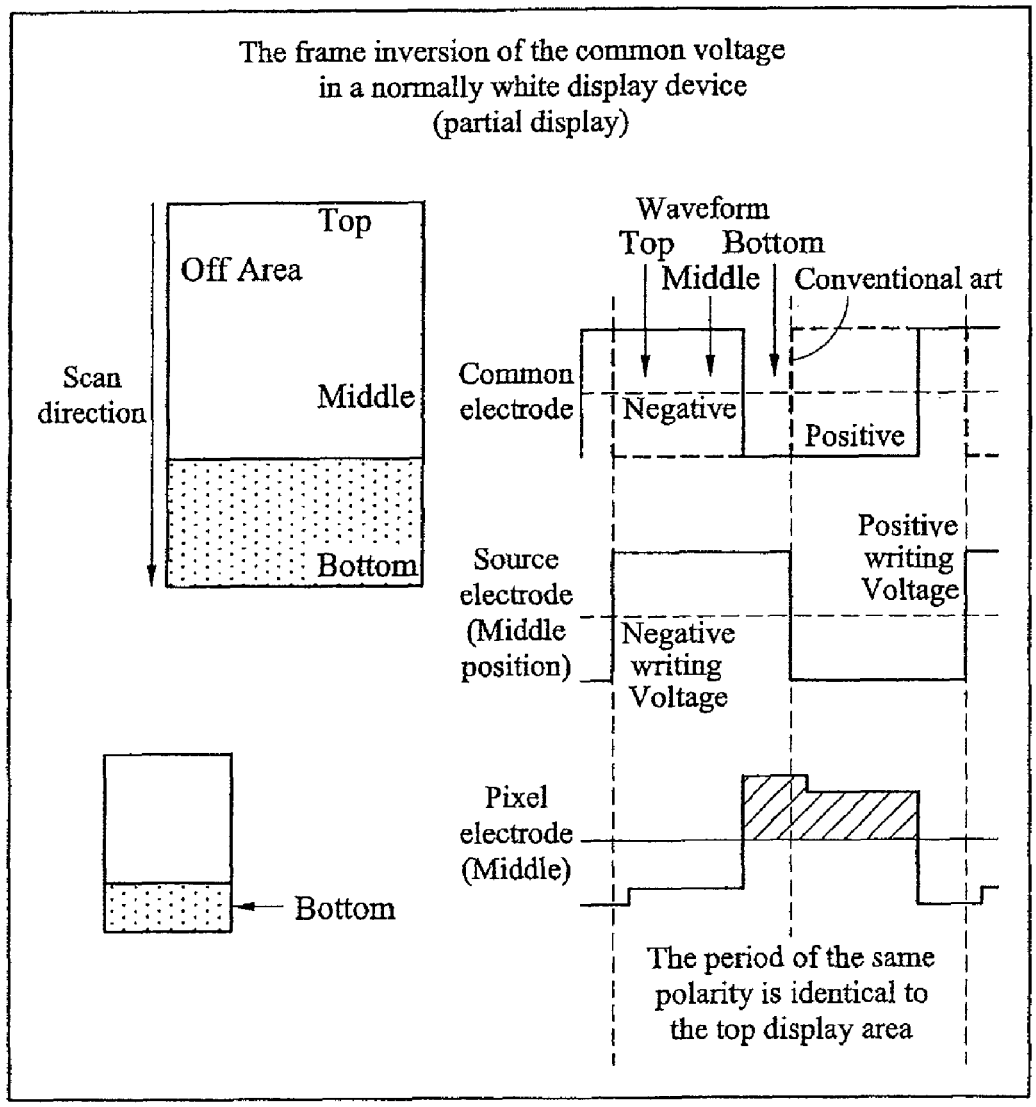
FIG. 2 depicts a display condition of a black image in a partial display mode and voltage waveform of each electrode in an active matrix liquid crystal display device using a method for driving an active matrix liquid crystal display device according to the second embodiment of the invention.

FIG. 2 depicts a display condition of a black image for partially display and voltage waveform of each electrode in an active matrix liquid crystal display device using a method for driving the active matrix liquid crystal display device according to the second embodiment of the invention. Specifically, FIG. 2 depicts a display condition of a black image displayed on a bottom display area for partially display and voltage waveform of each electrode in an active matrix liquid crystal display device driven by the frame inversion of the common voltage when the method of the invention is employed to normally white liquid crystal display.

FIG. 1 depicts the middle display area in a partially displayed mode, whereas FIG. 2 depicts the bottom display area in a partially displayed mode.

The waveform of the common voltage of the common electrode controlled by the method of the invention is synchronized with the scan timing of the pixel electrodes on the top of the bottom display area. Thus, the waveform of the common voltage is synchronized with the polarity inversion timing of the pixel voltage applied and held on the pixel electrodes on the top of the bottom display area using polarity inversion.

Compared with the waveform of the common voltage of the common electrode synchronizing with the scan timing of the pixel electrodes on the top of the display area in the conventional method, the polarity inversion timing of the common voltage in the second embodiment of the method of the invention is delayed only in the period from the scan timing of the pixel electrodes on the top of the entire display area to the scan timing of the pixel electrodes on the top of the bottom display area, as shown in FIG. 2.

The waveform of the common voltage of the common electrode is the same as the waveform of the common voltage shown in FIG. 6, except for the deviation of the polarity inversion timing. The alternative voltage with a low level at positive polarity and a high level at negative polarity is applied on the common electrode in each frame period.

A positive writing voltage, which is at a high level during the positive frame period of the common voltage, and a negative writing voltage, which is at a low level during the negative frame period of the common voltage, are provided from the source electrode during the scan timing of the pixel electrodes on the bottom display area in the partially displayed mode.

Although the second embodiment of the invention of FIG. 2 corresponds to the conventional method shown in FIG. 7, since the polarity inversion timing of the common voltage is different, the waveform of the writing voltage provided from source driving circuit to the pixel electrode on the bottom display area in the partially displayed mode is also different.

In FIG. 7, since the polarity inversion timing of the common voltage is the same as the polarity inversion timing of the writing voltage near the end of the frame periods of scanning the pixel electrode on the bottom display area, the writing voltage is at a high level in the positive frame period and at a low level in the negative frame period.

In the second embodiment of the invention of FIG. 2, the common voltage is synchronized with the scan timing of the pixel electrodes on the top of the bottom display area and the common voltage is inverted in polarity. Thus, for example, the common voltage is in the negative frame period before the polarity inversion timing in the initial frame period, and is in the positive frame period after the polarity inversion timing in the initial frame period. Before the polarity inversion timing in the initial frame period, a negative writing high-level voltage is provided as a negative white writing voltage. After the polarity inversion timing in the initial frame period, a positive writing high-level voltage is provided as a positive black writing voltage.

In the next frame period, the common voltage is in the positive frame period before the polarity inversion timing of the common voltage, and in the negative frame period after the polarity inversion timing of the common voltage. In the next frame period, a positive writing low-level voltage is provided as a positive white writing voltage before the polarity inversion timing. After the polarity inversion timing in the next frame period, a positive writing low-level voltage is provided as a negative black writing voltage.

Although the waveform of the writing voltage of the second embodiment of the invention in FIG. 2 is the same as the waveform of the writing voltage of the bottom display area represented by the dash line in FIG. 7, since the polarity inversion timing of the common voltages is different, the waveform is different.

Since the polarity inversion timing is controlled, the pixel voltage, as shown in FIG. 2, has no reduction caused by the polarity inversion of the common voltage. Only when the level of the writing voltage changes, the pixel voltage will slightly reduce during the positive frame period and slightly rise during the negative frame period.

In FIG. 2, the integral value of the pixel voltage of a pixel electrode on the bottom display area in the voltage holding period in the partially displayed mode, that is, the area of the hatched portion of the waveform of the pixel voltage, is the same as the area of the hatched portion of the waveform of the pixel voltage of the pixel electrode on the top display area during the voltage holding period in FIG. 7.

The display depth of each display area is proportional to the integral value of the pixel voltage of the pixel electrodes on each display area during the voltage holding period.

Based on the method of the invention, the bottom display area in the partially displayed mode has the same display depth as that of the top display area in the partially displayed mode in the conventional art.

The partial display in the described embodiments can be applied to the middle display area or the bottom display area, which have the same display depth as the top display area in the conventional method.

The depth gradient problem in the partially split display condition (two separated display areas are displayed) can be improved by the method of the invention.

Figure 3:
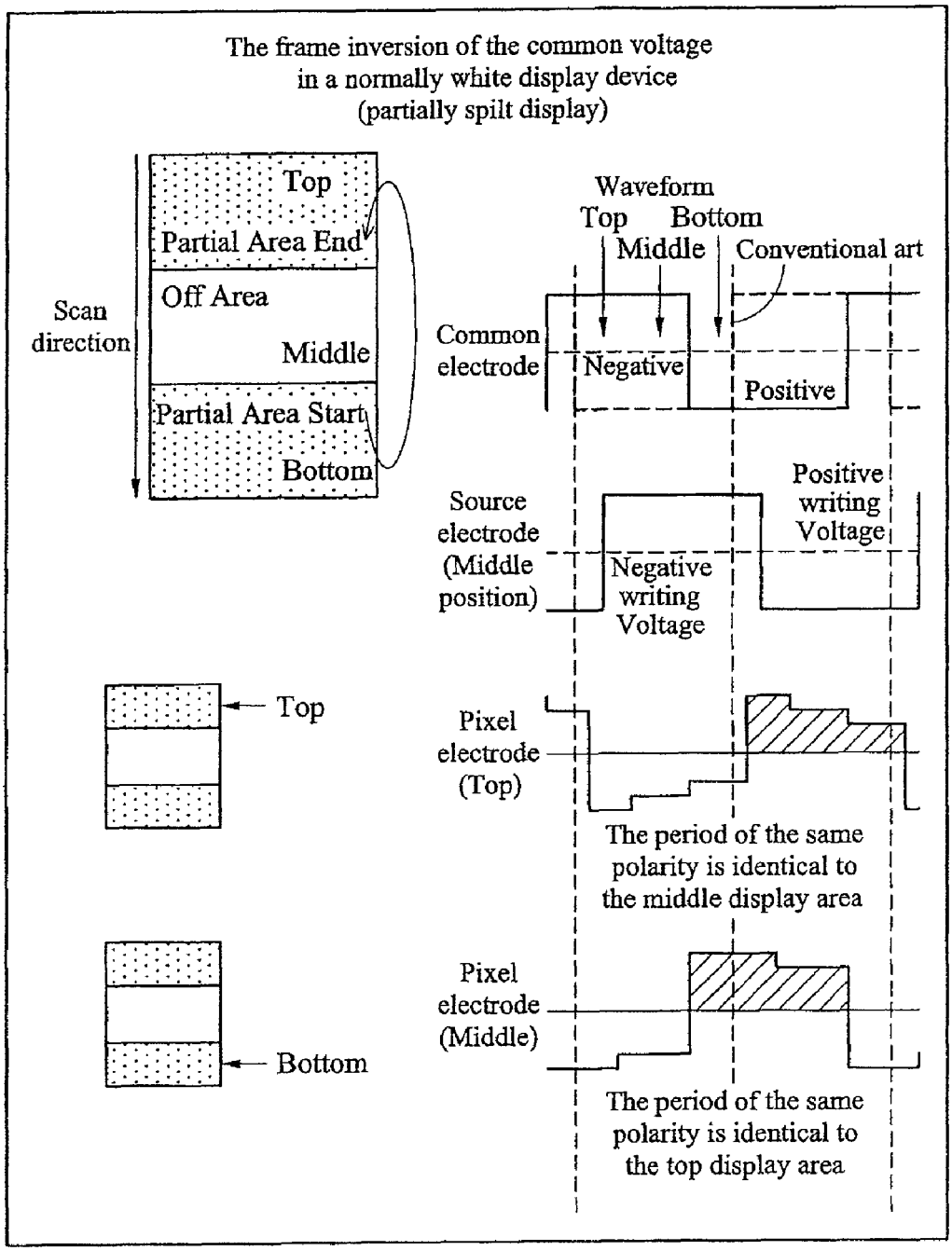
FIG. 3 depicts a display condition of a black image in a partially split display mode and voltage waveform of each electrode in an active matrix liquid crystal display device using a method for driving an active matrix liquid crystal display device according to the third embodiment of the invention.

FIG. 3 depicts a display condition of a black image of separate display areas for partially split display and voltage waveform of each electrode in an active matrix liquid crystal display device using a method for driving the active matrix liquid crystal display device according to the third embodiment of the invention. Specifically, FIG. 3 depicts a display condition of a black image on a display area for partially split display and voltage waveform of each electrode in an active matrix liquid crystal display device driven by the frame inversion of the common voltage when the method of the invention is employed to normally white liquid crystal display.

In this embodiment, the top and bottom display areas are displayed, and the middle display area is OFF.

The waveform of the common voltage controlled by the method of the invention is synchronized with scan timing of the pixel electrodes on the top of the bottom display area by polarity inversion.

With the pixel electrodes in the split top and bottom display areas along the scan direction, as shown in FIG. 3, a continuous scan area is formed from the top of the bottom display area to the bottom of the top display area.

The waveform of the common voltage controlled by the method of the invention is synchronized with the scan timing of the pixel electrodes on the top of the bottom display area, in which the top display area and the bottom display area constitute a continuous scan area in the partially split display mode. That is, the waveform of the common voltage is synchronized with the polarity inversion timing of the pixel voltage applied and held on the pixel electrodes on the top of the bottom display area by polarity inversion.

Compared with the waveform of the common voltage of the common electrode controlled by the conventional method, which is synchronized with the scan timing of the pixel electrodes on the top of the entire display area, the polarity inversion timing of the common voltage in the third embodiment of the method of the invention is delayed only in the period from the scan timing of the pixel electrodes on the top of the entire display area to the scan timing of the pixel electrodes on the top of the bottom display area, as shown in FIG. 3.

The waveform of the common voltage of the common electrode is the same as the waveform of the common voltage shown in FIG. 6, except for the deviation of the polarity inversion timing. The alternative voltage, with a low level at positive polarity and a high level at negative polarity, is applied on the common electrode in each frame period.

Since the waveform of the common voltage of the third embodiment is synchronized with scan timing of the pixel electrodes on the top of the bottom display area by polarity inversion, the common voltage of the third embodiment has the same waveform as the second embodiment of the invention as shown in FIG. 2.

A positive writing voltage, which is at high level during the positive frame period of the common voltage, and a negative writing voltage, which is at low level during the negative frame period of the common voltage, are provided from the source electrode during the scan timing of the pixel electrodes on the bottom display area in the partially split display mode.

Figure 8:
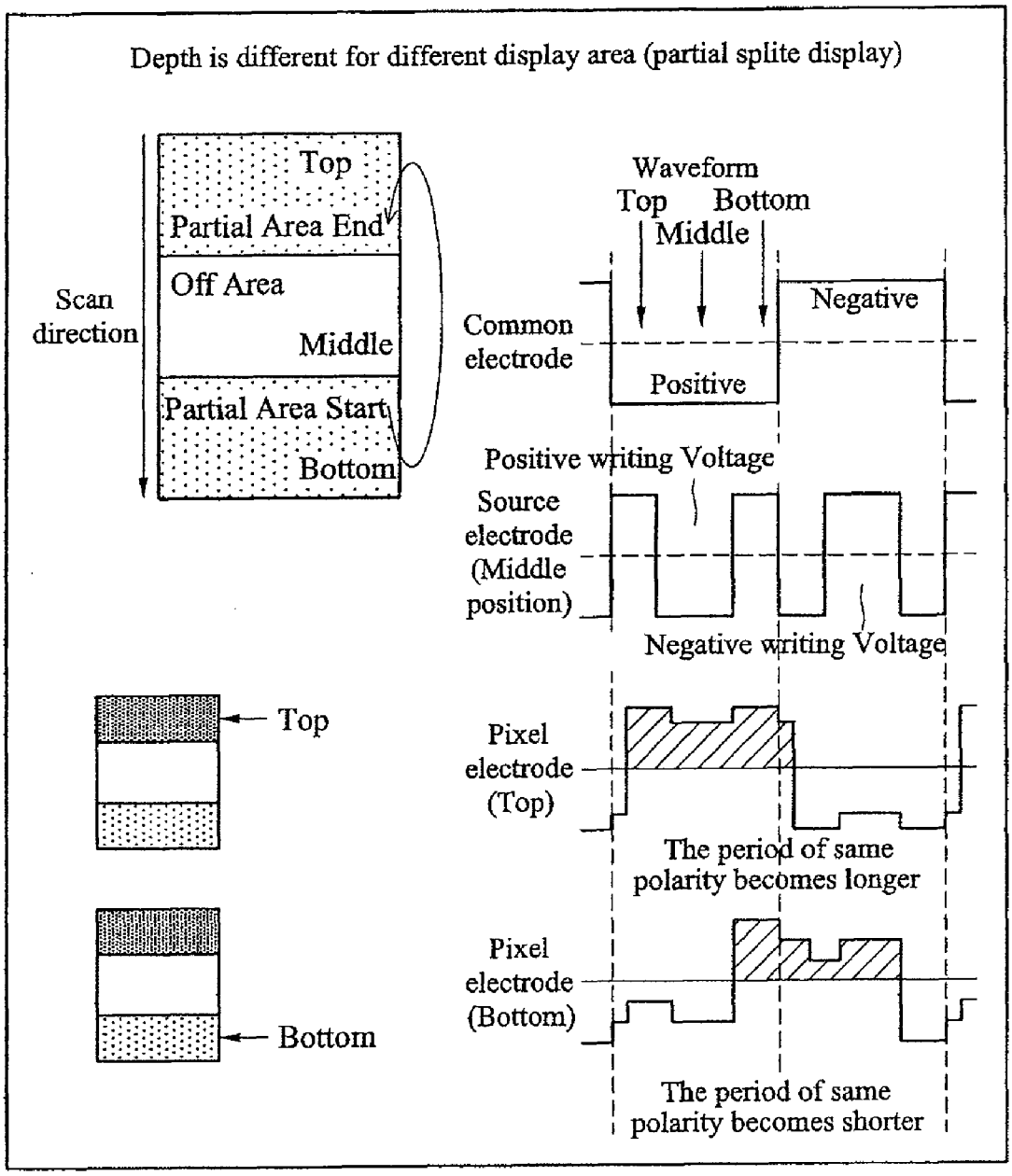
FIG. 8 (PRIOR ART)
FIG. 8 depicts a display condition of a black image in the partially split display mode and voltage waveform of each electrode in an active matrix liquid crystal display device driven by a conventional method, in which a normally white display device is driven by frame inversion inverting the common voltage waveform to partially display.

Although the third embodiment of the invention of FIG. 3 corresponds to the conventional method shown in FIG. 8, since the polarity inversion timing of the common voltage is different, the waveform of the writing voltage provided from source driving circuit to the pixel electrode on the top and bottom display areas in the partially split display mode is also different.

In FIG. 8, since the polarity inversion timing of the common voltage is the same as the polarity inversion timing of the writing voltage, near the initial and the end of the frame periods of scanning the pixel electrode on the top and bottom display areas, the writing voltage is at a high level in the positive frame period and at a low level in the negative frame period.

In the third embodiment of the invention of FIG. 3, the common voltage is synchronized with the scan timing of the pixel electrodes on the top of the bottom display area and the common voltage is inverted in polarity. Thus, for example, the common voltage is in the negative frame period of the common voltage before the polarity inversion timing in the initial frame period, and in the positive frame period of the common voltage after the polarity inversion timing in the initial frame period. Before the polarity invert timing in the initial frame period, a negative writing high-level voltage is provided as a negative white writing voltage. Near the beginning point of the mentioned initial frame period, a negative writing low-level voltage serving as a negative black writing voltage is provided to the top display area. After the polarity inversion timing in the initial frame period, a positive writing high-level voltage serving as a positive black writing voltage is provided to the bottom display area.

The common voltage is in the positive frame period before the polarity inversion timing of the common voltage in the next frame period, and in the negative frame period after the polarity inversion timing of the common voltage in the next frame period. Before the polarity inversion timing in the next frame period, a positive writing high-level voltage serving as a positive black writing voltage is provided to the top display area. Before the polarity inversion timing of the common voltage, a positive writing low-level voltage serving as a positive white writing voltage is provided to the middle display area. After the polarity inversion timing in the next frame period, a negative writing low-level voltage serving as a negative black writing voltage is provided to the bottom display area.

Although the waveform of the writing voltage of the third embodiment of the invention in FIG. 3 is the same as the waveform of the writing voltage in FIG. 8, since the polarity inversion timing of the common voltage is different, the waveform is different.

Since the polarity inversion timing of the common voltage is controlled, the pixel voltage at the bottom display area, as shown in FIG. 3, has no reduction caused by the polarity inversion of the common voltage. Only when the level of writing voltage changes, the pixel voltage will slightly reduce during the positive frame period and slightly rise during the negative frame period.

One-step reduction or rise occurs when the pixel voltage at the top display area is held on the pixel electrode by the inversion of common voltage. Since only one-step reduction or rise occurs by the change of the writing voltage, as shown in FIG. 3, one more step reduction or rise does not occur despite the voltage reduction or rise caused by the varied writing voltage levels.

In FIG. 3, the integral value of the pixel voltage of the pixel electrode on the bottom display area in the voltage holding period in the partially split display mode, that is, the area of the hatched portion of the waveform of the pixel voltage, is the same as the area of the hatched portion of the waveform of the pixel voltage of the pixel electrode on the top display area during the voltage holding period, as shown in FIGS. 7 and 8.

In FIG. 3, the integral value of the pixel voltage of the pixel electrode on the top display area in the voltage holding period in the partially split display mode, that is, the area of the hatched portion of the waveform of the pixel voltage, is the same as the area of the hatched portion of the waveform of the pixel voltage of the pixel electrode on the middle display area during the voltage holding period in FIG. 7.

The display depth of each display area is proportional to the integral value of the pixel voltage of the pixel electrodes on each display area during the voltage holding period.

Based on the method of the third embodiment of the invention, the top and bottom display areas in the partially split display mode have the same display depth as that of the top display area or middle display area in the partially displayed condition in the conventional art . . . .

Although the described embodiments of the method are applied to the partial display or partially split display condition using frame inversion, the method of the invention can also applied to partial display using DC common voltage.

Figure 4:
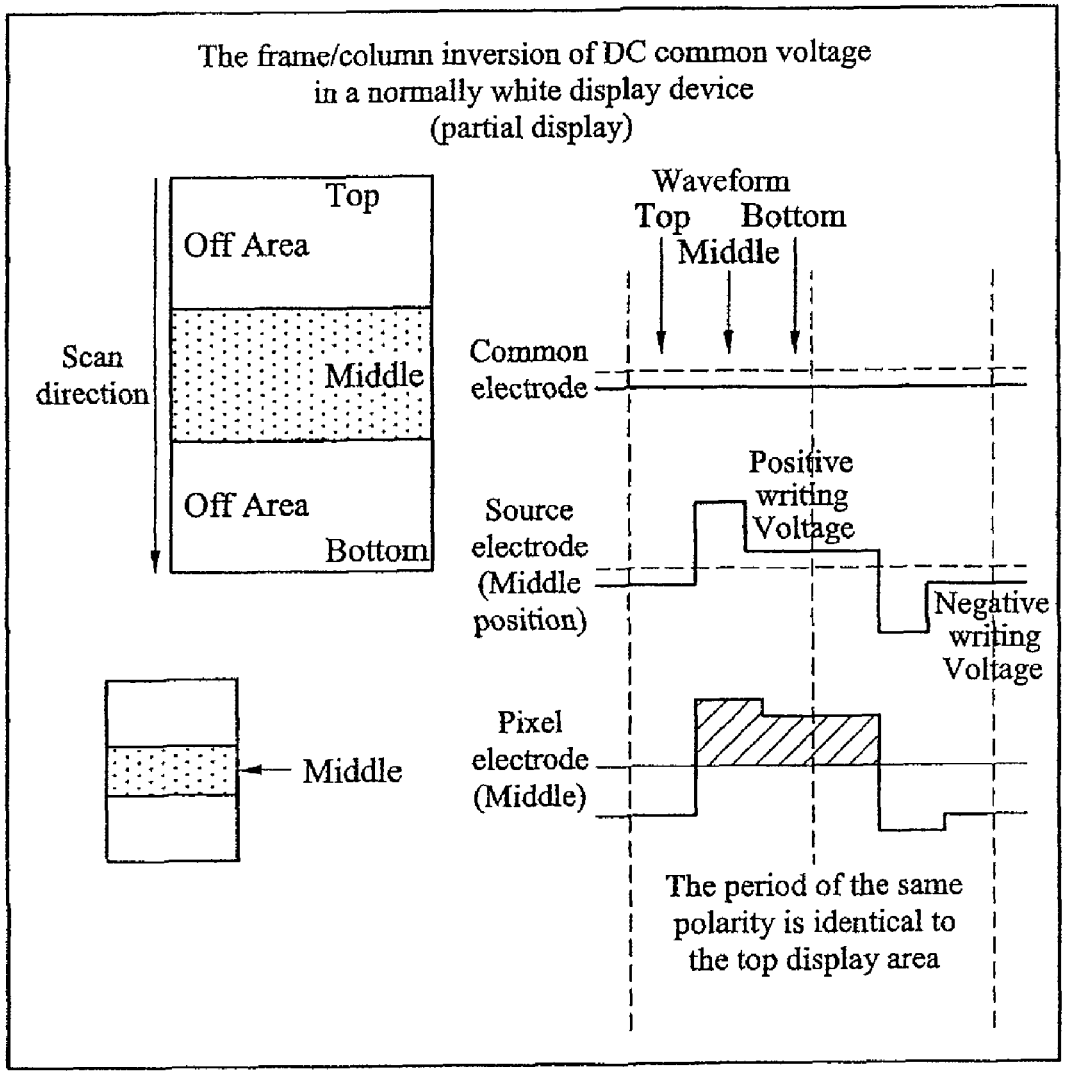
FIG. 4 depicts a display condition of a black image in a partial display mode and voltage waveform of each electrode in an active matrix liquid crystal display device using a method for driving an active matrix liquid crystal display device according to the fourth embodiment of the invention.

FIG. 4 depicts a display condition of a black image for partial display and voltage waveform of each electrode in an active matrix liquid crystal display device using a method for driving the active matrix liquid crystal display device according to the fourth embodiment of the invention. Specifically, FIG. 4 depicts a display condition of a black image for partial display and voltage waveform of each electrode in an active matrix liquid crystal display device driven by DC common voltage when the method of the invention is employed to normally white liquid crystal display.

In the embodiment of FIG. 4, since the common voltage is a DC voltage, the common voltage is kept constant.

During the scan timing of the display areas in the partial display, for the black display areas, positive writing voltage (with a high level with respect to the intermediate value of the source voltage amplitude) and negative writing voltage (with a low level with respect to the intermediate value of the source voltage amplitude) are provided from a source driving circuit to the positive output source bus and the negative output source bus, respectively, as the black writing voltage.

Although the embodiment of FIG. 4 describes the black display in the partially displayed mode, it can also be applied to the white display. During the scan timing of the display areas in the partial display, for the white display areas, positive writing voltage (with a high level with respect to the intermediate value of the source voltage amplitude) and negative writing voltage (with a low level with respect to the intermediate value of the source voltage amplitude) are provided from a source driving circuit to the positive output source bus and negative output source bus, respectively, as the white writing voltage.

In the fourth embodiment of the invention, however, the influence from polarity inversion and level changes of writing voltage to the waveform is completely suppressed. The polarity inversion timing of the common voltage is controlled to be synchronized with the timing of the scanning the position of the partial display area.

Figure 9:
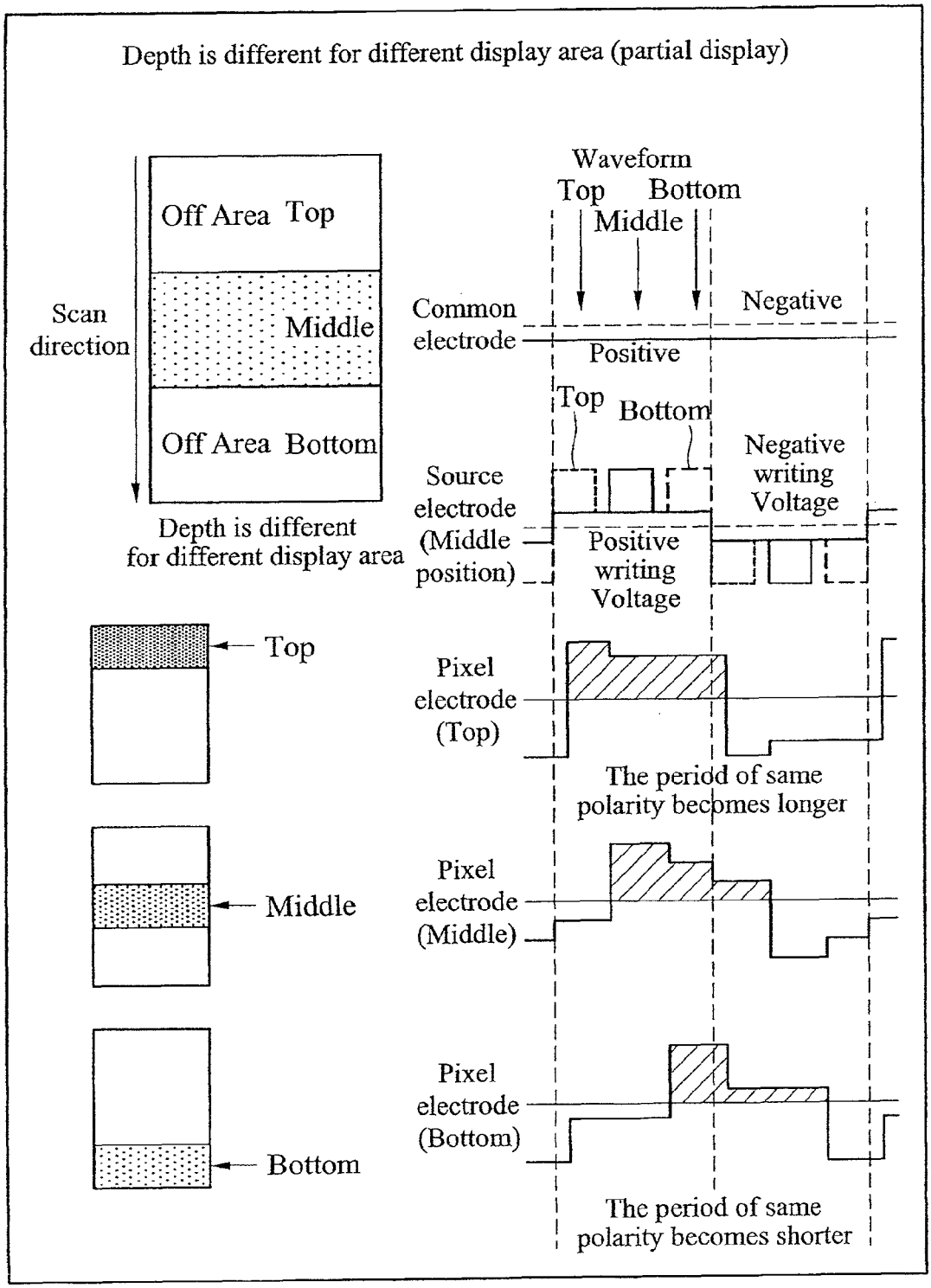
FIG. 9 (PRIOR ART)
FIG. 9 depicts a display condition of a black image in the partial display mode and voltage waveform of each electrode in an active matrix liquid crystal display device driven by a conventional method, in which a normally white display device is driven by frame/column inversion with the DC common voltage for partial display.

When the display area is not the top display area, as shown in FIG. 9, the waveform of the common source voltage for the display of the top display area in the partially displayed mode is controlled to make the polarity inversion timing of the writing voltage be synchronized with the scan timing of scanning the position of the partial display area.

FIG. 4 depicts the waveforms of the source voltage and pixel voltage in the middle display area in the partially displayed mode.

Since the writing voltage has polarity inversion with the polarity inversion timing being synchronized with the timing of scanning the position of the partial display area, during the scan timing of the display areas in the partial display, for the black display areas, positive writing voltage (with a high level with respect to the intermediate value of the source voltage amplitude) are provided to the positive output source bus and negative writing voltage (with a low level with respect to the intermediate value of the source voltage amplitude) are provided to the negative output source bus.

Correspondingly, from the scan timing of the pixel electrode of the middle display area, the pixel voltage shown in FIG. 4 is applied and held on the pixel electrodes in a frame period.

Even if the common voltage is a DC voltage, since the level of the writing voltage from the source electrode varies during the voltage holding period in the partially displayed mode, the pixel voltage held on the pixel electrode reduces or rises.

For example, in the middle display area for partial display, the positive writing voltage from a source electrode for a black display changes from a high level to a positive writing voltage for a white display during the positive frame period of the writing voltage and the voltage holding period of the pixel electrode on the middle display area. Thus, the pixel voltage held on the pixel electrodes on the middle display area has one-step reduction corresponding to the varied levels of the positive writing voltage, as shown in FIG. 4.

Similarly, the negative writing voltage from the source electrode for a black display changes from a low level to a negative writing voltage for a white display during the negative frame period of the writing voltage and the voltage holding period of the pixel electrode on the middle display area. Thus, the pixel voltage held on the pixel electrodes on the middle display area has one-step reduction corresponding to the varied levels of the positive writing voltage, as shown in FIG. 4.

In the fourth embodiment of the method of the invention, since the polarity inversion timing of the writing voltage is controlled to be synchronized with the timing of scanning the position of the display areas in the partially displayed mode, the writing voltage has no polarity inversion during the voltage holding period of the pixel electrode in the middle display area in the partially displayed mode.

Due to the polarity inversion of the writing voltage, the pixel voltage does not rise or reduce. As shown in FIG. 4, the rise or reduction of the pixel voltage of the pixel electrode stays in the one-step condition during the positive frame period and the negative frame period of the writing voltage.

The integral value of the pixel voltage of the pixel electrode on the middle display area in the voltage holding period in the partially displayed mode, that is, the area of the hatched portion of the waveform of the pixel voltage, is the same as the area of the hatched portion of the waveform of the pixel voltage of the pixel electrode on the top display area during the voltage holding period in FIG. 9.

The display depth of each display area is proportional to the integral value of the pixel voltage of the pixel electrodes on each display area during the voltage holding period.

Based on the method of the invention, even if the common voltage is a DC voltage, the middle display area in the partially displayed mode has the same display depth as that of the top display area in the partially displayed mode in the conventional art.

Similarly, even if the common voltage is a DC voltage, the bottom display area in the partially displayed mode has the same display depth as the top display area in the partially displayed mode of the conventional art.

Figure 5:
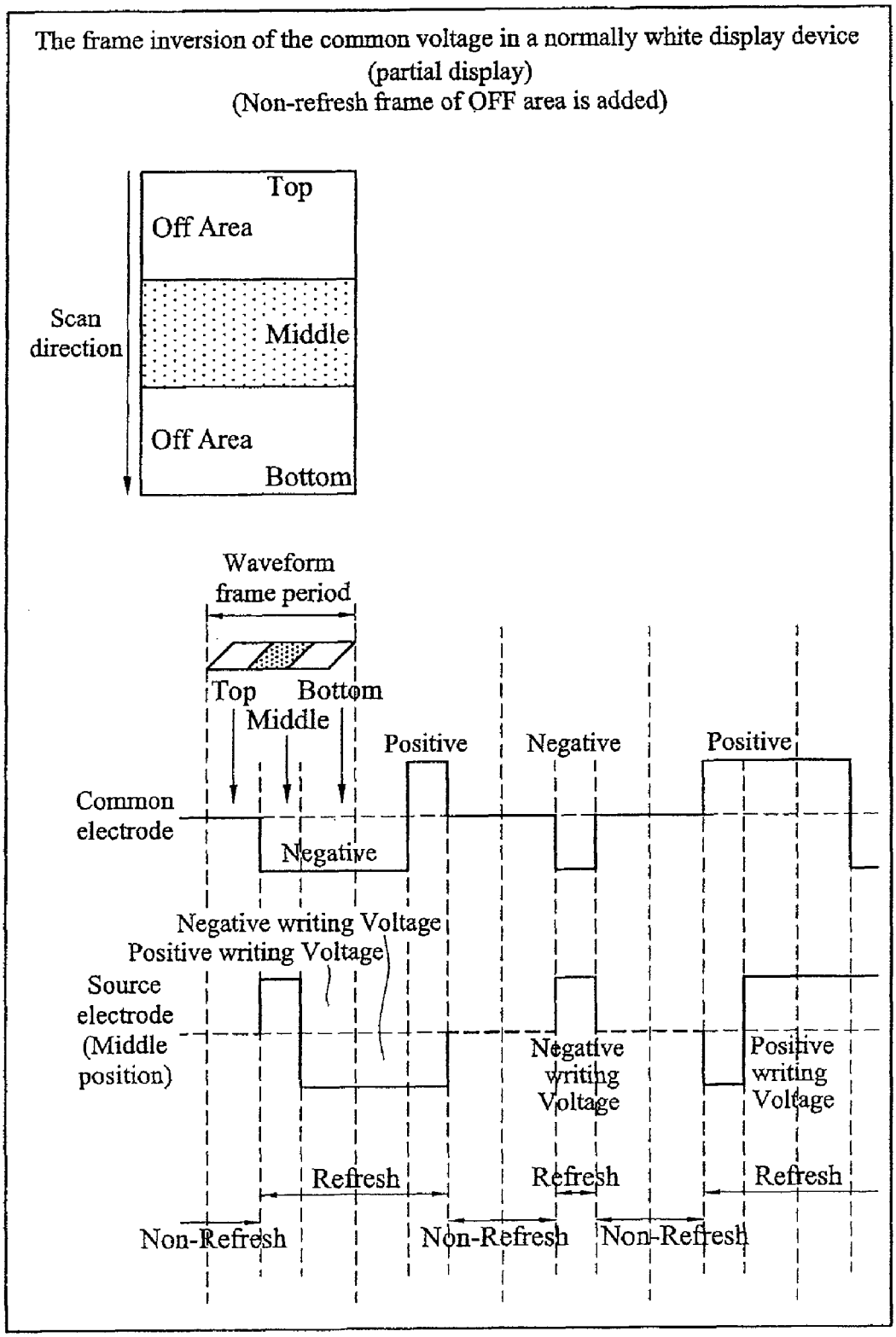
FIG. 5 depicts a display condition of a black image in a partial display mode and voltage waveform of each electrode in an active matrix liquid crystal display device using a method for driving an active matrix liquid crystal display device according to the fifth embodiment of the invention.

FIG. 5 depicts a display condition of a black image for partial display and voltage waveform of each electrode in an active matrix liquid crystal display device using a method for driving an active matrix liquid crystal display device according to the fifth embodiment of the invention.

Specifically, the method of the fifth embodiment of the invention is modified from the first embodiment of the invention. In the method for driving an active matrix liquid crystal display device, a normally white display device is driven by inverting the common voltage waveform. The method controls the waveform of the common voltage and the writing voltage when the middle display area is displayed and a part of the frame period corresponding to the scan period for the OFF area serves as non-refresh frame period.

FIG. 5 shows a case that the middle display area is displayed in the partially displayed mode. The part of the frame period corresponding to scan period of the pixel electrode on the OFF area (top and bottom display areas) serves as a non-refresh frame period which is not scanned.

During the non-refresh frame period, since the OFF area is not scanned, the common voltage and the writing voltage is zero and the power consumption is reduced by insertion of non-refresh periods into refresh periods.

Figure 10:
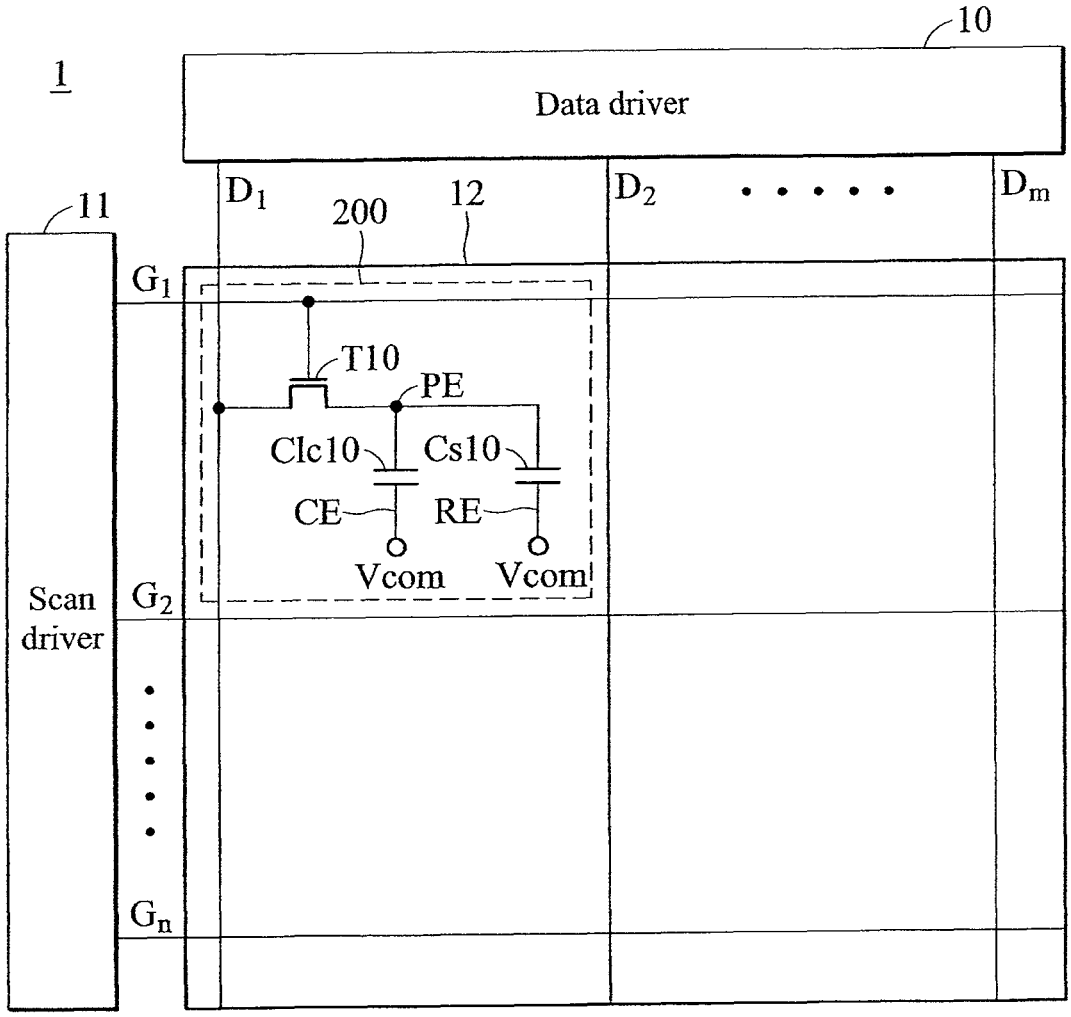
FIG. 10 depicts an active matrix liquid crystal display device driven by the method for the embodiments of the invention.

FIG. 10 depicts an active matrix liquid crystal display device driven by the method of the invention.

The active matrix liquid crystal display device 1 comprises pixels 200 arranged in a matrix in a display area 12 on a transparent substrate, pixel electrodes PE disposed in the pixels 200, a common electrode CE facing pixel electrode PE and formed on the other substrate, a scan driver 11 scanning a control node of a transistor T10 connected to the pixel electrodes PE for scanning the pixel electrodes PE, a data driver 10 serving as a source electrode driving circuit providing the writing voltage to the pixel electrodes PE via the source electrode.

Figure 11:
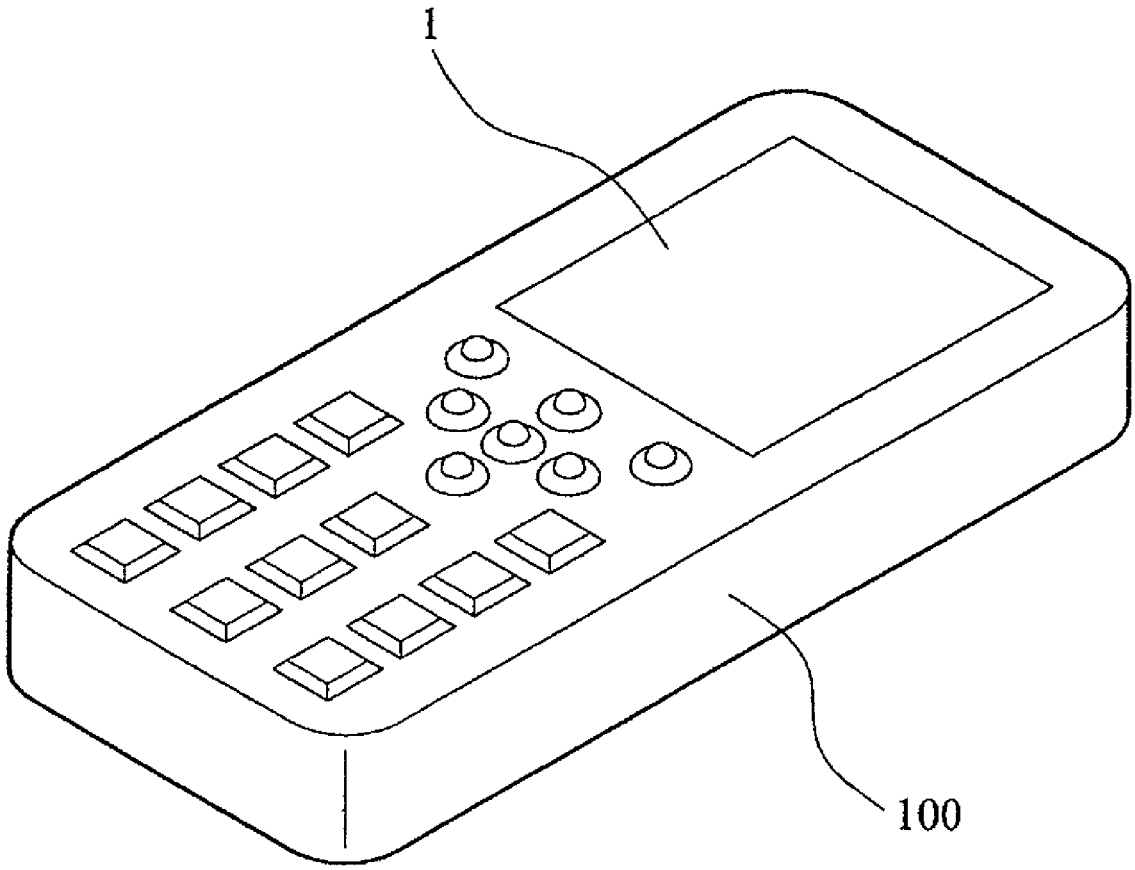
FIG. 11 depicts a mobile phone with an active matrix liquid crystal display device driven by the method for the embodiments of the invention.

FIG. 11 is a mobile phone with an active matrix liquid crystal display device driven by the method of the embodiments of the invention.

The active matrix liquid crystal display device driven by the method of the invention is applicable to the display device 1 of a mobile phone shown in FIG. 11. In addition to a mobile phone, the display device can also be applied to a digital camera, a personal digital assistant (PDA), a laptop, a desktop, a television, a vehicle display device, or a portable DVD device.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for driving an active matrix liquid crystal display, which drives a common voltage applied on a common electrode facing a pixel electrode by frame inversion for displaying a part of a display area, wherein the common voltage is controlled by synchronizing a polarity inversion timing of the common voltage with a scan timing of the pixel electrode in an initial position of the displayed area, wherein the polarity of the common voltage is inverted only once for each frame period, and wherein when a plurality of separated parts of the display area are displayed, the common voltage is controlled by synchronizing the polarity inversion timing of the common voltage with the scan timing of the pixel electrode in an initial position of one of the separated parts of the display area, which is located at the end of a scan direction to scan the separated parts of the displayed area.

2. The method as claimed in claim 1, wherein the polarity inversion timing of the common voltage is synchronized with a polarity inversion timing of the pixel voltage applied to the pixel electrode in the initial position of the displayed area.

3. The method as claimed in claim 2, wherein a part of a frame period corresponding to a period for scanning pixel electrodes in non-displayed areas becomes a non-refresh period, wherein the pixel electrodes are not scanned.

4. The method as claimed in claim 1, wherein a part of a frame period corresponding to a period for scanning pixel electrodes in non-displayed areas becomes a non-refresh period, wherein the pixel electrodes are not scanned.

5. The method as claimed in claim 1, wherein a part of a frame period corresponding to a period for scanning pixel electrodes in non-displayed areas becomes a non-refresh period, wherein the pixel electrodes are not scanned.

6. An electronic device, comprising an active matrix display device driven by the method as claimed in claim 1, wherein the electronic device is a mobile phone, a digital camera, a personal digital assistant, a laptop, a desktop, a television, a vehicle display device, or a portable DVD device.

* * * * *